US012188318B2

(12) United States Patent
Innes et al.

(10) Patent No.: US 12,188,318 B2
(45) Date of Patent: Jan. 7, 2025

(54) TOOL

(71) Applicant: SPEX GROUP HOLDINGS LIMITED, Aberdeen (GB)

(72) Inventors: Martin Derrick Innes, Aberdeen (GB); Simon McKay, Banchory (GB)

(73) Assignee: SPEX GROUP HOLDINGS LIMITED, Aberdeen (GB)

( * ) Notice: Subject to any disclaimer, the term of this patent is extended or adjusted under 35 U.S.C. 154(b) by 57 days.

(21) Appl. No.: 17/776,532

(22) PCT Filed: Nov. 13, 2020

(86) PCT No.: PCT/EP2020/082134
§ 371 (c)(1),
(2) Date: May 12, 2022

(87) PCT Pub. No.: WO2021/094582
PCT Pub. Date: May 20, 2021

(65) Prior Publication Data

US 2022/0381102 A1 Dec. 1, 2022

(30) Foreign Application Priority Data

Nov. 13, 2019 (GB) ..... 1916511.7

(51) Int. Cl.
*E21B 29/02* (2006.01)
*E21B 43/116* (2006.01)
*E21B 43/263* (2006.01)

(52) U.S. Cl.
CPC ..... *E21B 29/02* (2013.01); *E21B 43/116* (2013.01); *E21B 43/263* (2013.01)

(58) Field of Classification Search
CPC ..... E21B 43/263; E21B 29/02; E21B 43/248; E21B 43/116–11857
See application file for complete search history.

(56) References Cited

U.S. PATENT DOCUMENTS 4,798,244 A 1/1989 Trost
9,453,402 B1 9/2016 Barton
(Continued)

FOREIGN PATENT DOCUMENTS

CA 2512924 A1 1/2007
WO 2019060977 A1 4/2019

OTHER PUBLICATIONS

International Search Report and Written Opinion for corresponding PCT Application No. PCT/EP2020/082134, mailed Apr. 14, 2021.
(Continued)

*Primary Examiner* — Kristyn A Hall
(74) *Attorney, Agent, or Firm* — Tarolli, Sundheim, Covell & Tummino LLP

(57) ABSTRACT

A downhole tool (1) for manipulating a target, includes a housing (2). The housing includes an inner surface (5) configured for mounting to a tubular carrier; and an outer surface (10). At least one chamber (20) is provided between the inner surface (5) and the outer surface (10) and contains at least one propellant source (22) and an ignition system. One or more outlets (12) lead from the chamber (20) to the outer surface (10), for combustion products from the at least one propellant source. The downhole tool may be employed for perforating and may be included in a hydraulic fracturing assembly. A method of hydraulic fracturing in a wellbore using the tool is provided.

24 Claims, 5 Drawing Sheets

(56) References Cited

U.S. PATENT DOCUMENTS

| | | | | |
|---|---|---|---|---|
| 2001/0001418 | A1* | 5/2001 | Wesson | E21B 43/11852 166/308.1 |
| 2003/0213596 | A1* | 11/2003 | Davis | F16L 15/001 166/242.4 |
| 2004/0089450 | A1* | 5/2004 | Slade | E21B 41/0078 166/55.7 |
| 2011/0139433 | A1 | 6/2011 | Jackson | |
| 2015/0275643 | A1 | 10/2015 | Holder et al. | |
| 2016/0084055 | A1 | 3/2016 | Moore et al. | |
| 2017/0182743 | A1* | 6/2017 | Cribb | E21B 43/00 |
| 2019/0234179 | A1* | 8/2019 | Walton | E21B 43/26 |
| 2021/0310325 | A1* | 10/2021 | Oag | E21B 29/02 |

OTHER PUBLICATIONS

Saudi Authority for Intellectual Property Substantive Examination Report for corresponding Application #: 522432365 for applicant Speaks Group Holding Limited; pp. 1-16.

* cited by examiner

TOOL

RELATED APPLICATIONS

The present invention is a U.S. National Stage under 35 USC 371 patent application, claiming priority to Serial No. PCT/EP2020/082134, filed on 13 Nov. 2020; which claims priority from 1916511.7 filed 13 Nov. 2019; the entirety of which are incorporated herein by reference.

FIELD

The present invention relates to the field of downhole tools and associated methods that employ combustion products from a propellant to manipulate a target. The present invention finds application in the oil and gas industry and is particularly suitable for the perforation of tubulars, cement casings and rock formations

BACKGROUND

In the oil and gas industry downhole tools may be employed to perforate or sever tubulars or other structures present in a well.

A typical example of such activity is in hydraulic fracturing operations ('fracking').

In an exemplary method, a well is drilled and lined with a tubular casing. The casing may be cemented into place with a more or less continuous layer of cement provided as a seal between the casing and the surrounding formation. To provide access to the formation, a number of 'perforating guns' may be deployed downhole. The perforating guns employ means such as shaped charge explosives to punch holes through the casing, any associated cement layer and into the formation. The perforating guns are then removed and a number of 'fracking sleeves' (or 'frac sleeves') are deployed, fitted to a tubular (such as coiled tubing). The fracking sleeves provide fluid communication, via opening ports, from the interior of the tubular to the annulus between the tubular and the casing.

Fracking liquids including proppant solids are then pumped down the coiled tubing and out through the ports in the fracking sleeves, to pressurise the annulus. (Packers are used to isolate the annulus along sections of the well.)

The hydraulic pressure of the fracking liquids fractures the formation via the holes in the casing previously made by the perforating guns. After withdrawal of the fracking sleeve and packer arrangements the well produces hydrocarbons (e.g. methane) from the hydraulically fractured rock formation.

Although a number of tools and methods have been developed for perforating or severing structures downhole there remains the need for improved tools and methods.

SUMMARY

According to a first aspect of the invention there is provided a downhole tool for manipulating a target, wherein the tool comprises a housing, the housing comprising:

an inner surface configured for mounting to a tubular carrier in use;

an outer surface;

at least one chamber provided between the inner surface and the outer surface and containing at least one propellant source;

an ignition system for igniting propellant at the at least one propellant source; and one or more outlets leading from the chamber to the outer surface, for combustion products from the at least one propellant source.

In use, the combustion products emanating from an outlet or outlets can, for example, manipulate a target, such as a tubular, by, for example, ablation, cutting, displacement, removal, heating, abrasion, or erosion and/or consuming.

The inner surface may take the form of the surface of a bore passing through the tool from a first end to a second end. The inner surface or bore may be sized to fit about a tubular such as a coiled tubing carrying one or more frac sleeves i.e. the tubular carrier may comprise a coiled tubing. The inner surface mounts onto the tubular carrier and is configured to allow the passage of fluid through the tubular carrier.

Alternatively the inner surface of the tool may form a portion of the wall of a tubular carrier such as a coiled tubing.

In a convenient form the tool has an inner surface comprising a generally cylindrical bore passing through from a first end to a second end of the housing. The tool may be generally cylindrical. The outer surface of the tool may be generally cylindrical.

The outlet or outlets lead from the at least one chamber to the outer surface of the housing. The chamber or chambers is/are provided between the inner and outer surfaces of the housing. A chamber may have one or more outlets for combustion products emanating from a propellant source or sources contained within the chamber. The outlets release combustion products from a respective chamber. The outlets may be shaped to control the combustion products direction and/or focus.

The term 'propellant source' used herein means a location of propellant material provided for ignition. Thus, a propellant source within the chamber or chambers may comprise or be a charge (portion) of a propellant composition, or components for a propellant composition, placed at a location within the chamber. Alternatively, a propellant source may be an opening into the chamber from a supply system that feeds propellant composition, or the components for a propellant composition, for ignition. Feeding the tool with propellant allows the tool to be used continuously after ignition. The propellant may be fed into the housing in the form of a solid, liquid, paste, foam, gel or gas composition or a combination of these.

Chambers including a charge of propellant as propellant source are convenient. For example chambers may include blocks of solid propellant, that may be shaped to fit the chamber geometry. In some examples an outlet may be placed to exit more or less centrally from an associated chamber. Two or more propellant sources may be placed so as to direct their combustion products towards each other (i.e. the charges are opposed to each other). The flows of combustion products interact as they collide and then exit via the outlet. Without wishing to be bound by theory, tests have shown that the flow of combustion products from each propellant source in a tool where the propellant charges are opposed to each other appear to interact within the chamber—one against the other. This may produce results that may be more consistent and/or effective than those of arrangements using only one propellant source in the chamber. The combustion products may include gases, solid and/or liquid particles and in some cases plasma.

Propellants are generally classified as explosives for transportation purposes. Thus a propellant is a generally explosive material which has a low rate of combustion and once ignited burns or otherwise decomposes (i.e. deflagrates) to produce propellant gas. This gas is highly pressurised, the pressure driving the gas and other combustion products away from the propellant, forming a stream of combustion products. A propellant can burn smoothly and at a uniform rate after ignition without depending on interaction with the atmosphere and produces propellant gas and/or heat on combustion; and may also produce additional combustion products. The use of a propellant rather than a conventional explosive charge, such as a shaped charge arrangement, may provide a more controlled and/or sustained attack on a target.

The housing defines one or more chambers and the propellant source or sources are located within the chamber or chambers. Ignited propellant can develop a pressure of combustion products within its respective chamber, which can then exit the tool via one or more respective outlets. An outlet may comprise one or more apertures, which can each act as nozzles for jets of combustion products emanating from a respective chamber.

The outlets may be closed before the propellant is ignited, and open following ignition. This may be achieved in a number of ways. The outlets may be sealed, for example with a fusible material, such as a relatively low melting point metal. The combustion products generated following ignition of the propellant melt or decompose the seal. Alternatively the pressure generated within a chamber following ignition of the propellant may move a part, such as a piston, to uncover the outlet.

The tool may take the form of a downhole perforator, typically with a plurality of outlets spaced apart circumferentially and/or axially about the outer surface of the housing. An elongate generally cylindrical tool may comprise a first array of axially spaced apart outlets along the outer surface and a second array of axially spaced outlets diametrically opposite the first. The first array may be axially spaced apart on the outer surface along a line parallel with the longitudinal axis of the tool and the second along the diametrically opposite line. An array of outlets may comprise at least two, typically three or more outlets.

Alternatively a generally cylindrical perforator tool may have two or more arrays of outlets, each array comprising circumferentially spaced apart outlets with each array axially spaced from the next along the length of the housing. This arrangement can allow simpler manufacture, as each array of outlets may be provided on a circumferential ring that forms part of the generally cylindrical outer surface of the tool. In such an arrangement the outlets of one array may be circumferentially staggered with respect to the outlets of the next array along the length of the housing.

In a convenient arrangement a generally cylindrical perforating tool may include one or more circumferential rings. Each circumferential ring may include one or more outlets. The outer surface of the ring may provide a part of the outer surface of the housing of the tool. The outlet or outlets in the ring is/are in fluid communication with one or more chambers containing one or more propellant sources. In such a tool the chamber or chambers may be provided within one or more cylindrical sleeves. Thus the housing may comprise one or more cylindrical sleeves, and one or more circumferential rings providing a generally cylindrical housing with a bore therethrough.

Where the chamber or chambers are provided within cylindrical sleeves, the cylindrical sleeves, in particular the outer surface of the cylindrical sleeves, may be of metal, to provide durability. In such examples, during manufacture, the inner surface of the cylindrical sleeve may be formed as a layer after insertion of propellant source, ignition system components etc. within the chamber or chambers. For example the inner surface may be formed of a thermosetting resin or other polymer, such as a phenolic resin. Similarly, a cavity within a cylindrical sleeve that is used to form chambers may be divided into two or more chambers by the use of blocks of a thermosetting resin or other polymer.

Perforating tools as described herein may find use in connecting a wellbore to a production reservoir. They may also find particular use in methods of hydraulic fracturing such as are described in more detail hereafter.

The tools of the invention may further comprise a control module. The control module may include items such as electronic control of the ignition system; and a sensor or sensors for monitoring downhole positioning and/or conditions such as pressure and temperature. Signalling between the control module and the surface may be by wire or wireless connection.

The tools include an ignition system for igniting the propellant. The ignition mechanism may include an ignition device at each of the propellant sources. The ignition devices may be controlled to ignite propellant at the respective propellant source simultaneously or substantially simultaneously. For example, a control signal (by wire or wireless) from a control module may cause activation of the ignition device to ignite the propellant at each propellant source. However, it has been found that ignition at one propellant source in a chamber of a tool will tend to rapidly cause ignition at the other or further propellant sources contained within the same chamber. Therefore, only one ignition device may be provided within each chamber.

The propellant ignition mechanism may be any suitable arrangement for the propellant employed, such as those used in the oil and gas industry or the space industry to ignite combustible or explosive materials. Examples include but are not limited to: electric or other direct heating; non-explosive and explosive chemical ignition (such as propellants or other pyrotechnics); spark plug or other electric discharge; and the like.

To aid in protecting the outer surface of the tool from damage during deployment downhole, the tool may be provided with a protector or protectors, typically one at either end. The protectors may have a larger diameter than the housing. For example in a cylindrical tool of the invention the protectors may be generally cylindrical and be fitted to the first and second ends. Where the inner surface of the tool is in the form of a bore, the protectors may be provided with a bore for the passage of a tubular carrier. A protector may have a conical or generally conical end, narrowing in the direction away from the housing. This can aid in deploying the tool downhole, especially when passing through a restricted diameter section of the well bore.

A protector may have one or more passages therethrough, to allow fluid in the annulus to pass.

Protectors may be fitted to the tool. Alternatively protectors may be fitted to a tubular carrier and the tool fitted adjacent e.g. in contact with the protector on the tubular carrier. Thus the protector or protectors may be provided as part of an assembly including the tool and a tubular carrier.

The present invention also provides a method of hydraulic fracturing in a wellbore, the method comprising the steps of:

a) deploying a tubular carrier downhole in a rock formation, wherein the tubular carrier mounts at least one downhole perforator tool as described herein and includes at least one frac sleeve and two or more packers for isolating sections of the annulus;

b) operating the downhole perforator to produce access holes into the rock formation;

c) setting the packers to isolate a section of the annulus including the access holes and the at least one frac sleeve; and d) pumping fracking fluid through the tubular carrier and out of the at least one frac sleeve into the annulus, to fracture the rock formation via the access holes.

After the fracturing step is completed the method may continue by unsetting the packers, to release sealing contact, and removing the tubular carrier. The well may then produce hydrocarbon product from the rock formation via the wellbore.

Where the tool includes more than one downhole tool and associated frac sleeve or sleeves, together with associated packers, then the method may include repetition of steps b) and c). (Making use of further downhole perforator/frac sleeve and packer arrangements already fitted to the tubular carrier.) In this way one deployment of one tubular carrier may allow multiple perforation and fracking steps to be carried out in a wellbore.

It will be appreciated that steps b) and c) above may be carried out in the order b) and then c), or c) and then b), as desired. As an alternative all the perforation action may be carried out before setting the packers, or all the setting of packers may be done before perforating.

As a yet further alternative the tubular carrier may be left in situ and product produced from the well bore via the annulus and/or via the inside of the tubular carrier.

The present invention also provides a hydraulic fracturing assembly comprising:

a) a tubular carrier comprising one or more frac sleeves and two or more packers; and b) a downhole perforator tool, wherein the tool comprises a housing, the housing comprising:

an inner surface mounted to the tubular carrier;

an outer surface;

at least one chamber provided between the inner surface and the outer surface and containing at least one propellant source;

an ignition system for igniting propellant at the at least one propellant source; and one or more outlets leading from the chamber to the outer surface, for combustion products from the at least one propellant source.

The frac sleeves employed in the hydraulic fracturing methods and assemblies described herein may be of the conventional types, such as sliding sleeves that may be ball operated.

The perforator tool may be in accordance with any aspect of the tool for manipulating a target described herein.

DETAILED DESCRIPTION OF THE DRAWINGS

Figures 1A, 1B:
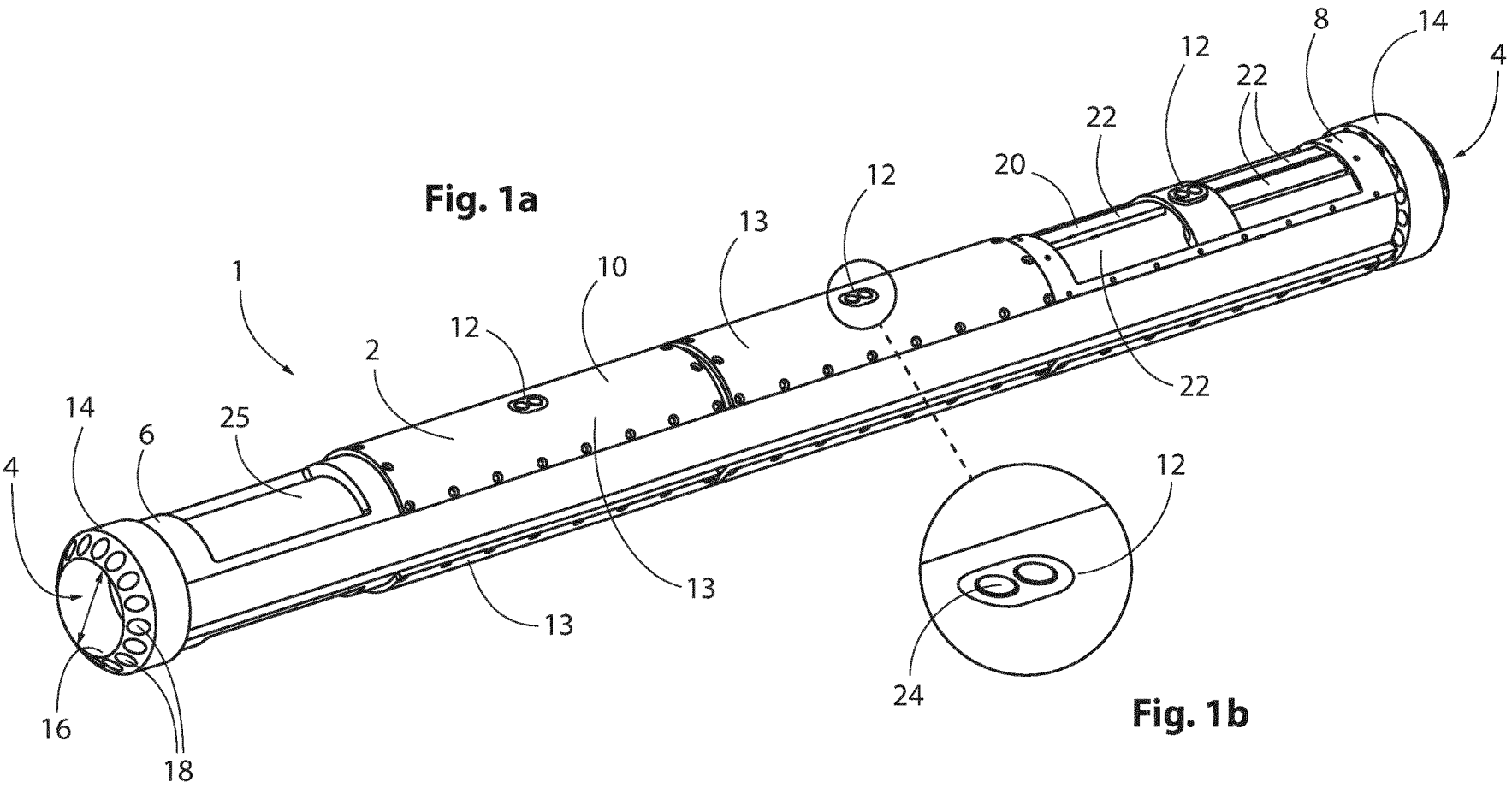
FIG. 1*a* shows a downhole tool in schematic perspective.
FIG. 1*b* shows in magnification, outlets of the tool shown in FIG. 1*a;*

FIG. 1*a* shows a downhole tool 1 in schematic perspective with some parts cut away to allow viewing of the interior. The tool 1 is a perforator tool and is cylindrical in form. Cylindrical housing 2 has a cylindrical bore 4, the surface 5 of the bore (see FIGS. 1*c* and 1*d*) provides an inner surface of the housing, running from a first end 6 through to a second end 8.

The outer surface 10 of the housing 2 includes outlets 12. The outer surface 10 includes cover plates 13 in this example, through which the outlets 12 emerge. Three outlets 12 are visible and constitute an array of outlets that are spaced axially on the outer surface 10 along a line parallel to the longitudinal axis of the tool. Not visible in this view is a corresponding array of outlets 12 diametrically opposite those that are in view.

Protectors 14 are fitted to the first 6 and second 8 ends of the housing 2. The protectors 14 are cylindrical and have a larger diameter than that of the housing 2. Ends 16 of the protectors 14 are conical, narrowing in the direction away from the housing 2. The protectors have passages 18 therethrough to allow fluid communication (see FIGS. 1*c* and 1*d*). Each outlet 12 has an associated chamber 20 between the inner surface 5 and the outer surface 10, one chamber 20 is visible by the cut away on the figure.

As shown at the cut away, the chamber 20 has the corresponding outlet 12 placed centrally. Charges 22 of solid propellant are placed in chamber 20 to either side of the outlet 12. Magnified view FIG. 1*b* shows that the outlets 12 comprise two apertures 24 constituting nozzles for the emanation of combustion products from the propellant charges 22, following their ignition. The apertures 24 are shown sealed with a fusible metal (e.g. zinc) that will be melted or even combusted when the propellant is ignited.

The tool 1 also includes a control module 25 that can receive wired or wireless communications from the surface and includes the electronics for an ignition system for propellant.

Figure 1E:
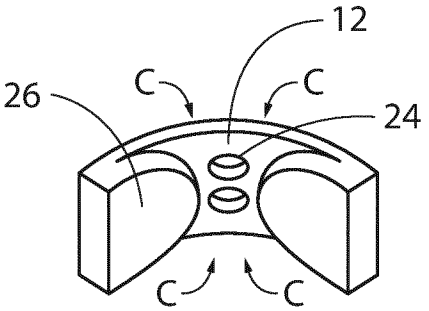
FIGS. 1*e* and 1*f* show details of outlets of the tool of FIG. 1*a;*
Figure 1D:
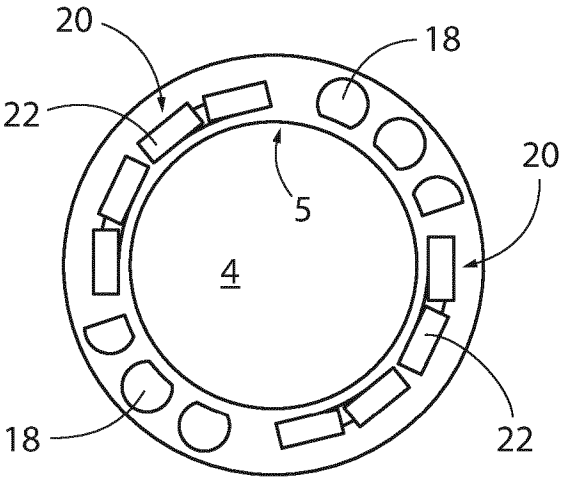
FIGS. 1*c* and 1*d* show schematic cross section views of the tool of FIG. 1*a;*
Figure 1F:
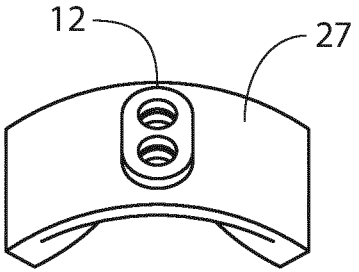
Figure 1C:
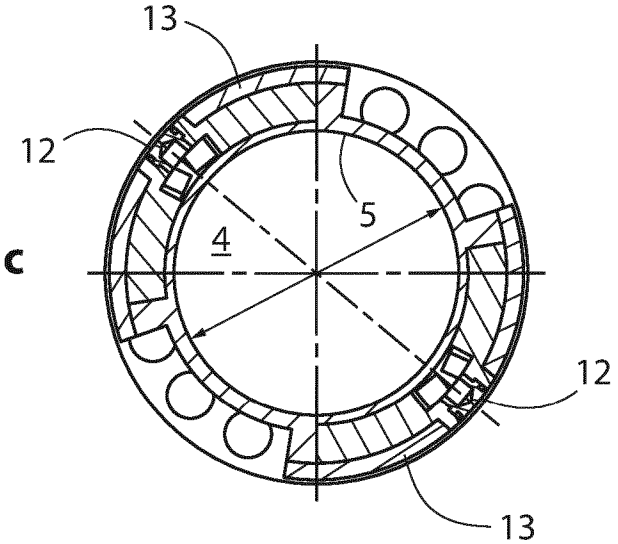

FIGS. 1*c* and 1*d* show cross sections of the tool 1 of FIG. 1*a*. FIG. 1*c* shows a section at diametrically opposed outlets 12, FIG. 1*d* shows the arrangement of propellant charges 22 within chambers 20. Details of outlets 12 are shown in FIGS. 1*e* and 1*f*. FIG. 1*e* shows the interior of an outlet 12 with shaped projections 26 (also visible in cross section FIG. 1*c*) for directing flows of combustion products (as suggested by arrows C) towards apertures 24. FIG. 1*f* shows the outer surface of outlet 12. The outlet 12 projects slightly above the surface 27 as a cover plate 13 surrounds it (see FIGS. 1*a* and 1*c*).

Figure 2:
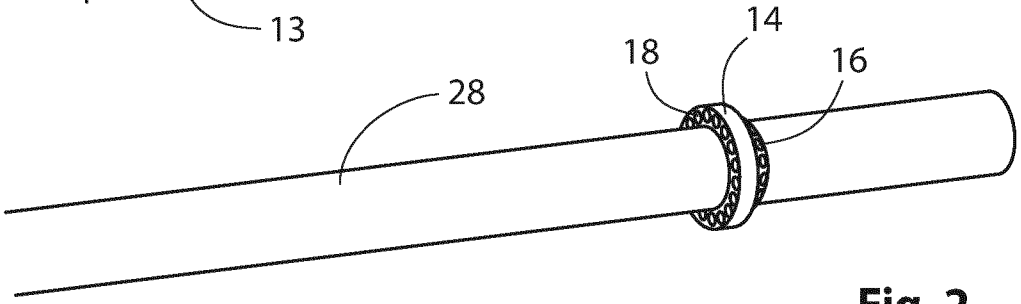
FIG. 2 shows a tool carrier in schematic perspective.

FIG. 2 shows a section of a tubular carrier 28 to which tools similar to those depicted in FIG. 1 can be fitted. In this example tubular 28 has a protector 14 fitted. A tool such as that shown in FIG. 1 but without protectors 14 fitted to the housing can be slid onto tubular carrier 28 until an end is adjacent protector 14. A further protector 14 can then be fitted onto tubular 28 adjacent the other end of the tool.

Figure 3A:
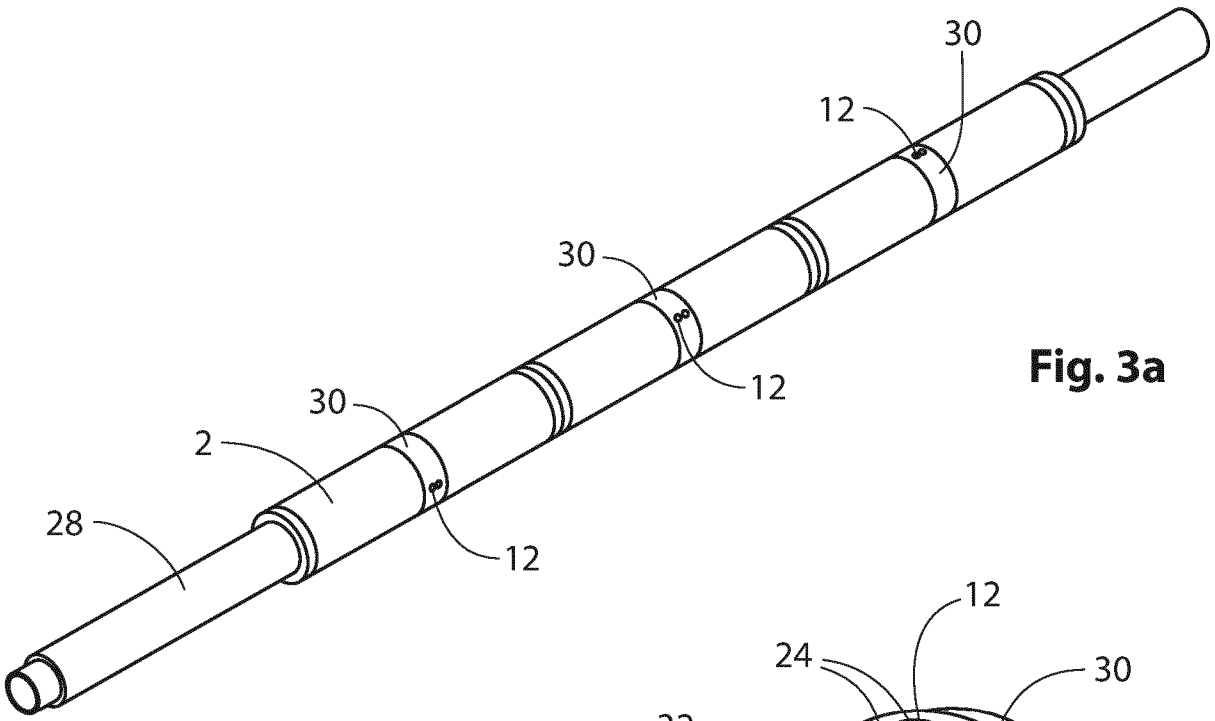
FIG. 3*a* shows a tool on a carrier in schematic perspective.

Part of an alternative tool 1 is shown fitted to a tubular carrier 28 in FIG. 3*a*. The housing includes circumferential rings 30, each having three outlets 12 about the circumference of the corresponding ring 30. The outlets 12 of one array 30 are staggered circumferentially with respect to the outlets 12 on the next array along the length of the tool.

Figure 3B:
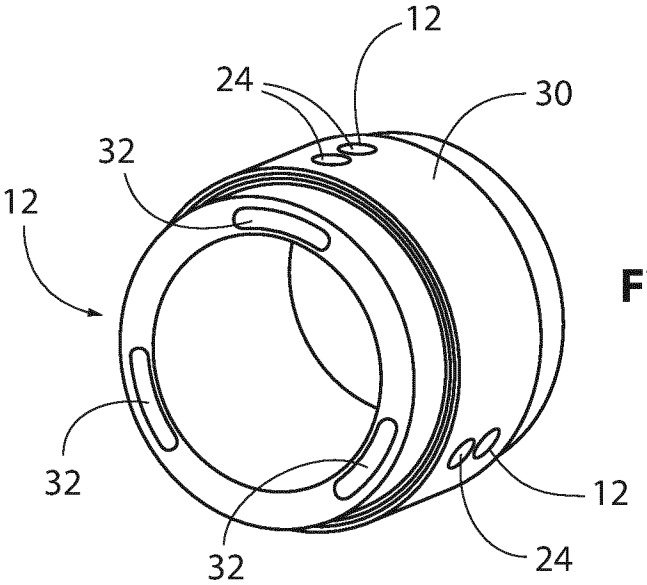
FIG. 3*b* shows a circumferential ring of the tool of FIG. 3*a;*

FIG. 3*b* shows a circumferential ring 30 for the tool of FIG. 3*a*. Outlets 12 are spaced at 120 degrees around the ring 30. Each outlet 12 has an inlet passage 32 for communication with a chamber containing a propellant source. Each outlet 12 has two apertures 24 on the outer surface of ring 30 for emanation of combustion products.

Figure 3C:
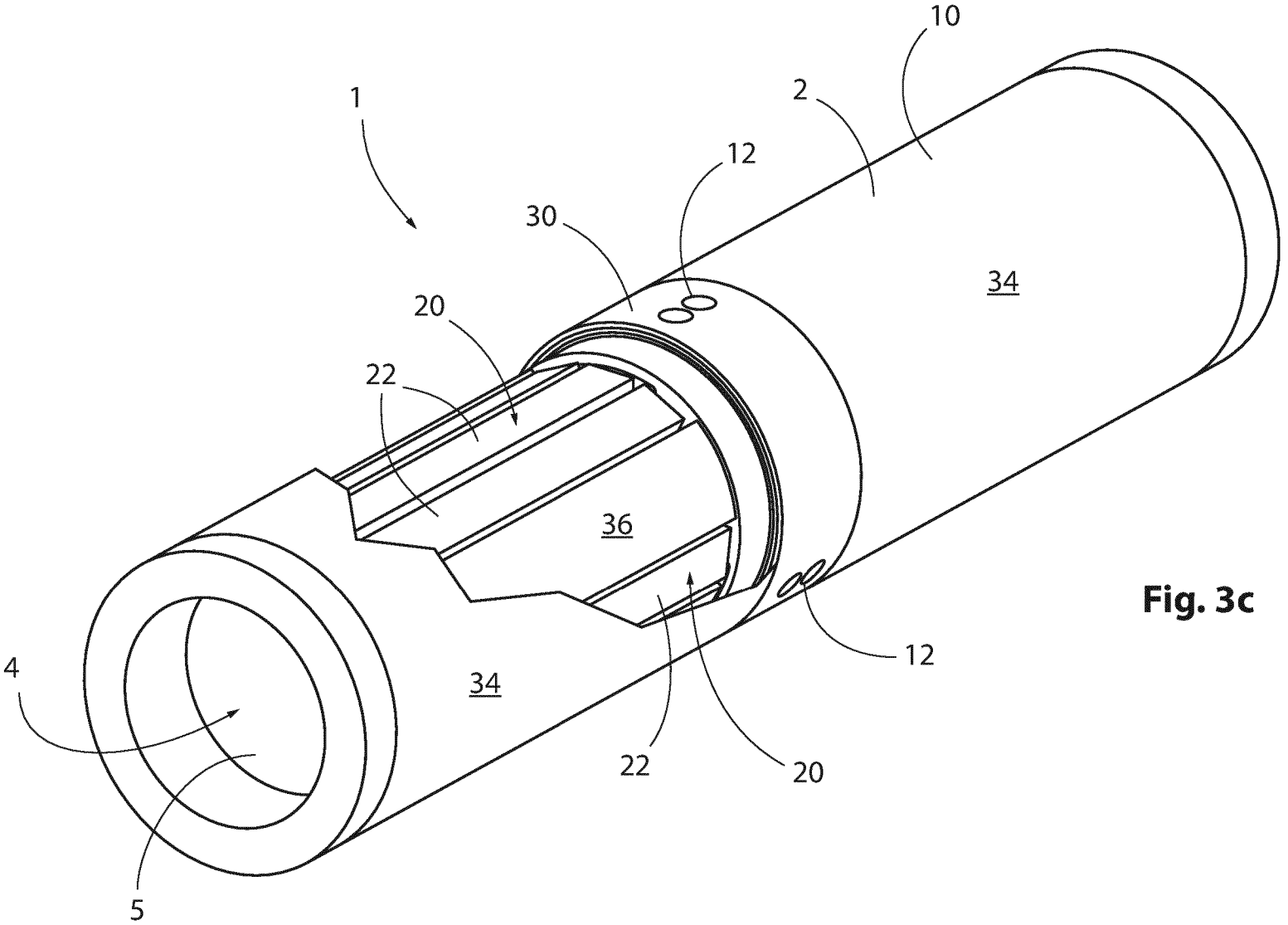
FIG. 3*c* shows in perspective view with cut away part of the tool of FIG. 3*a*.

FIG. 3*c* shows in perspective view with cut away part of the tool of FIG. 3*a*. In this example outer surface 10 of housing 2 comprises the outer surface of circumferential ring 30 and cylindrical sleeves 34, of metal. Inner surface 5 formed about bore 4 is formed of a resin, such as a phenolic resin. This arrangement allows access to chambers 20 during manufacture of the tool, to allow placement of propellant charges 22 in chambers 20. In this example blocks of a phenolic resin 36 are placed within the cavity defined by the inner surface 5 of the tool 1 and the inner surface of sleeves 34 to divide it into chambers 20. Thus each chamber 20 provides combustion products from propellant charges 22 to its respective outlet 12.

Figure 3E:
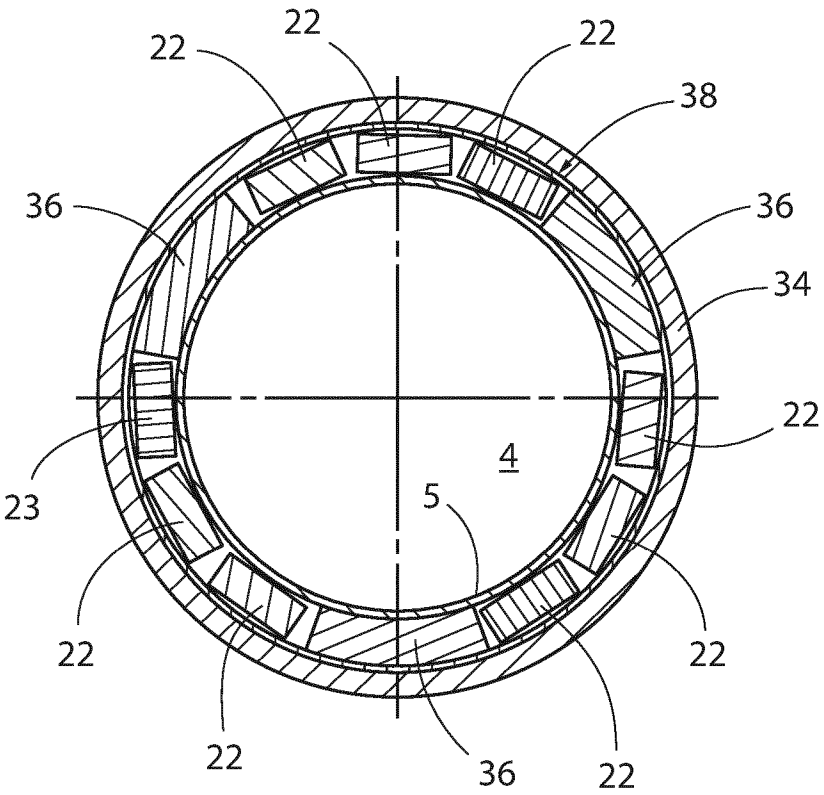
FIGS. 3*d* and 3*e* show cross section views of the tool 1 of FIG. 3*a*.
Figure 3D:
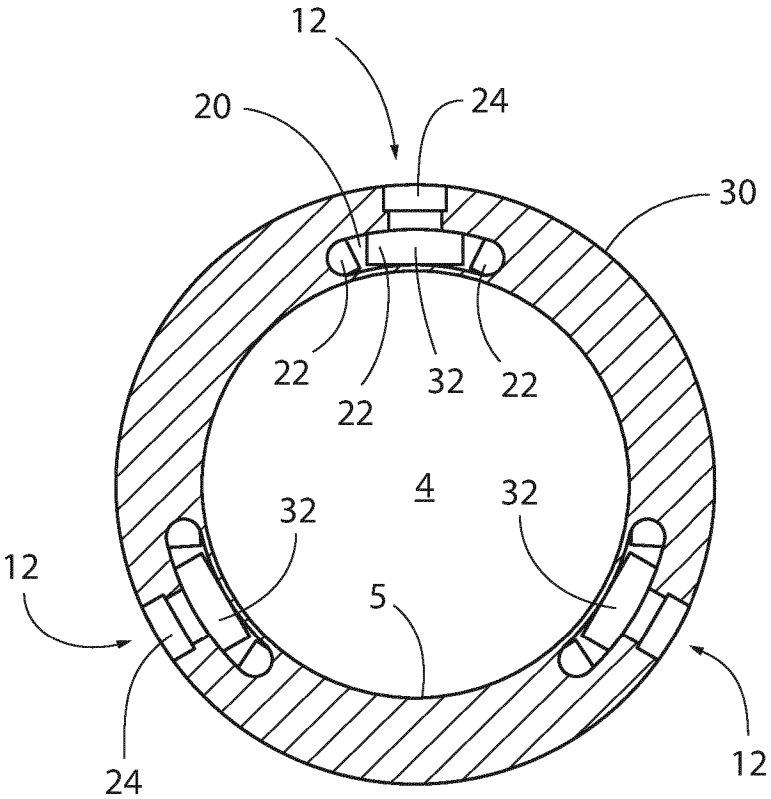

FIGS. 3*d* and 3*e* show cross section views of the tool 1 of FIG. 3*a*. In FIG. 3*d* the cross section is shown at a circumferential ring 30 allowing a view of outlets 12 and the inlet passages 32, through which propellant charges 22 in chambers 20 can be seen.

In FIG. 3*e* the cross section is shown through a cylindrical sleeve 34, and shows the arrangement of propellant charges 22 in chambers 20 around the circumference of the tool. Also visible in this view is an outer liner 38 of a phenolic resin provided about the whole inner surface of the cylindrical sleeve 34.

The invention claimed is:

1. A downhole perforator tool comprising a housing, the housing comprising:

an inner surface configured for mounting to a tubular carrier in use;

an outer surface;

two or more chambers provided between the inner surface and the outer surface and containing at least one propellant source;

an ignition system for igniting propellant at the at least one propellant source; and one or more outlets leading from the chambers to the outer surface, for combustion products from the at least one propellant source;

wherein the housing comprises cylindrical sleeves including the two or more chambers, and one or more circumferential rings including the one or more outlets, to provide a generally cylindrical housing with a bore therethrough;

wherein a cavity within the cylindrical sleeves is divided into the two or more chambers by blocks of a thermosetting resin or other polymer;

wherein the outer surface of the cylindrical sleeve or sleeves is of metal and the inner surface is of a thermosetting resin or other polymer;

wherein each outlet comprises one of more apertures which act as nozzles for jets of combustion products from the at least one propellant source; and whereby the jets of combustion products are configured to produce access holes into a rock formation.

2. The downhole perforator tool of claim 1 wherein the at least one propellant source comprises a charge of a propellant composition, or components for a propellant composition, placed at a selected location within the at least one chamber.

3. The downhole perforator tool of claim 2 wherein the at least one propellant source comprises one or more blocks of a solid propellant placed within the at least one chamber.

4. The downhole perforator tool of claim 1 wherein the at least one propellant source is an opening into the two or more chambers from a supply system that feeds a propellant composition or the components for a propellant composition into the two or more chambers for ignition by the ignition system.

5. The downhole perforator tool of claim 1 wherein two or more propellant sources are placed in the two or more chambers so as to direct their combustion products towards each other to provide flows of combustion products that interact as they collide before exiting the two or more chambers via the outlet.

6. The downhole perforator tool of claim 1 wherein at least one outlet comprises two or more apertures each of which acts as a nozzle for jets of combustion products following ignition of propellant.

7. The downhole perforator tool of claim 1 wherein the outlet or outlets are closed before ignition of propellant from the propellent source or sources.

8. The downhole perforator tool of claim 7 wherein the outlet or outlets are sealed before ignition of propellant.

9. The downhole perforator tool of claim 7 wherein pressure generated following ignition of propellant from the propellant source or sources moves a part or parts of the tool to uncover the outlet or outlets.

10. The downhole perforator tool of claim 1 comprising a plurality of outlets spaced apart circumferentially and/or axially about the outer surface.

11. The downhole perforator tool of claim 1, wherein the tool is elongate and generally cylindrical and comprises:

a first array of axially spaced apart outlets along the outer surface following a line parallel with the longitudinal axis of the tool and a second array of axially spaced outlets diametrically opposite the first.

12. The downhole perforator tool of claim 1, wherein the tool is elongate and generally cylindrical and comprises:

two or more arrays of outlets, each array comprising circumferentially spaced apart outlets with each array axially spaced from the next along the length of the housing.

13. The downhole perforator tool of claim 12, wherein each array of outlets is provided on a circumferential ring that forms part of the outer surface of the tool.

14. The downhole perforator tool of claim 13, wherein the outlets of one array are circumferentially staggered with respect to the outlets of the next array along the length of the housing.

15. The downhole perforator tool of claim 1 further comprising a control module.

16. The downhole perforator tool of claim 1 further comprising at least one protector having a larger diameter than the housing.

17. The downhole perforator tool of claim 16 comprising two protectors having a larger diameter than the housing, placed one at either end of the tool.

18. The downhole perforator tool of claim 17, wherein the tool is elongate and generally cylindrical and comprises generally cylindrical protectors, one fitted to each end of the housing.

19. The downhole perforator tool of claim 16 wherein at least one protector is provided with at least one passage for fluid therethrough.

20. The downhole perforator tool of claim 16 wherein the protectors have a conical end, narrowing in the direction away from the housing.

21. The downhole perforator tool of claim 1 wherein the inner surface is of a phenolic resin.

22. A hydraulic fracturing assembly comprising:

a) a tubular carrier comprising one or more frac sleeves and two or more packers; and b) a downhole perforator tool in accordance with claim 1.

23. A method of hydraulic fracturing in a wellbore, the method comprising the steps of:

a) deploying a tubular carrier downhole in a rock formation, wherein the tubular carrier mounts at least one downhole perforator tool as defined in claim 1, and includes at least one frac sleeve and two or more packers for isolating sections of the annulus;

b) operating the downhole perforator to produce access holes into the rock formation;

c) setting the packers to isolate a section of the annulus including the access holes and the at least one frac sleeve; and d) pumping fracking fluid through the tubular carrier and out of the at least one frac sleeve into the annulus, to fracture the rock formation via the access holes.

24. The method of claim 23 further comprising unsetting the packers, to release sealing contact, and removing the tubular carrier from the wellbore.

* * * * *